US012507758B2

(12) United States Patent
Despots Allaire et al.

(10) Patent No.: US 12,507,758 B2
(45) Date of Patent: Dec. 30, 2025

(54) SOLE COMPRISING A CURVED ELASTIC PLATE

(71) Applicant: ON CLOUDS GMBH, Zürich (CH)

(72) Inventors: Renaud Despots Allaire, Zürich (CH); Johannes Voelchert, Zürich (CH); Rebecca Alonzo, Zürich (CH); Elias Miguel Ortiz, Zürich (CH); Kevin Dellion, Zürich (CH); Benoit Abel, Zürich (CH); Nils Arne Altrogge, Zürich (CH)

(73) Assignee: ON CLOUDS GMBH, Zurich (CH)

( * ) Notice: Subject to any disclaimer, the term of this patent is extended or adjusted under 35 U.S.C. 154(b) by 0 days.

(21) Appl. No.: 18/279,934

(22) PCT Filed: Mar. 8, 2022

(86) PCT No.: PCT/EP2022/055930

§ 371 (c)(1),
(2) Date: Sep. 1, 2023

(87) PCT Pub. No.: WO2022/189449

PCT Pub. Date: Sep. 15, 2022

(65) Prior Publication Data

US 2024/0138513 A1 May 2, 2024

(30) Foreign Application Priority Data

Mar. 10, 2021 (CH) ..... 00260/21
Oct. 8, 2021 (CH) ..... 70364/2021

(51) Int. Cl.

| | |
|---|---|
| ***A43B 13/12*** | (2006.01) |
| ***A43B 5/06*** | (2022.01) |
| ***A43B 7/32*** | (2006.01) |
| ***A43B 13/02*** | (2022.01) |
| ***A43B 13/18*** | (2006.01) |

(52) U.S. Cl.
CPC ..... *A43B 5/06* (2013.01); *A43B 7/32* (2013.01); *A43B 13/026* (2013.01);
(Continued)

(58) Field of Classification Search
CPC ..... A43B 5/06; A43B 13/026; A43B 13/12; A43B 13/127; A43B 13/18; A43B 13/183
(Continued)

(56) References Cited

U.S. PATENT DOCUMENTS 2,413,545 A * 12/1946 Leander ..... A43B 13/18 273/DIG. 18
3,039,207 A * 6/1962 Lincors ..... A43B 13/18 36/58.5

(Continued)

FOREIGN PATENT DOCUMENTS

DE 699 25 427 T2 2/2006
DE 10 2020 125 150 A1 4/2021

(Continued)

OTHER PUBLICATIONS

EPO (Rijswijk, NL), English language version of the International Search Report, Form PCT/ISA/210, for International Application PCT/EP2022/055930, May 25, 2022 (2 pages).

*Primary Examiner* — Marie D Bays
(74) *Attorney, Agent, or Firm* — Pauley Erickson & Swanson

(57) ABSTRACT

A sole for a running shoe comprising a sole tip, a heel edge and a midsole having a base surface delimiting the midsole against the vertical direction (V) and a top surface delimiting the midsole in the vertical direction, wherein the midsole has a heel region (FB), a midfoot region (MFB) and a forefoot region (VFB) and an elastic plate. The elastic plate extends at least from the forefoot region into the midfoot region, and in the forefoot region and/or in the midfoot region has a first (Continued)

curvature with a vertex curved along the longitudinal direction (L) of the midsole in the direction of the top surface of the midsole. The elastic plate is formed so the first curvature is elastically bent in the direction of the base surface by the forces acting during treading and/or rolling movement, and the first curvature returns to its original shape during push-off, or wherein the elastic plate in the forefoot region and/or in the midfoot region has a first curvature curved along the longitudinal direction of the midsole in the direction of the base surface of the midsole and having a vertex. The elastic plate is configured such that the first curvature is elastically bent in the direction of the top surface by the forces acting during treading and/or during rolling movement, and the first curvature returns to its original shape during push-off.

27 Claims, 5 Drawing Sheets

(52) U.S. Cl.
CPC ..... *A43B 13/125* (2013.01); *A43B 13/127* (2013.01); *A43B 13/183* (2013.01); *A43B 13/185* (2013.01)

(58) Field of Classification Search
USPC ..... 36/27
See application file for complete search history.

(56) References Cited

U.S. PATENT DOCUMENTS 6,205,681 B1 3/2001 Kita
6,247,249 B1 * 6/2001 Lindqvist ..... A43B 13/12 36/31
2003/0000109 A1 * 1/2003 Kita ..... A43B 13/188 36/31
2005/0198863 A1 * 9/2005 Hockerson ..... A43B 5/06 36/25 R
2006/0137227 A1 6/2006 Kita et al.
2006/0254087 A1 * 11/2006 Fechter ..... A43B 13/183 36/27
2006/0265902 A1 * 11/2006 Kita ..... A43B 13/183 36/12
2009/0241373 A1 * 10/2009 Kita ..... A43B 13/143 36/44
2011/0138652 A1 * 6/2011 Lucas ..... A43B 13/14 36/28
2012/0246969 A1 * 10/2012 Baum ..... A43B 13/188 36/27
2015/0047224 A1 * 2/2015 Zhao ..... A43B 13/223 36/28
2015/0089834 A1 * 4/2015 Baum ..... A43B 13/181 36/27
2016/0029741 A1 2/2016 Foxen
2016/0058123 A1 * 3/2016 Peyton ..... A43B 13/141 36/25 R
2017/0354200 A1 12/2017 Orand et al.
2018/0116335 A1 5/2018 Worobets et al.
2019/0104805 A1 * 4/2019 Del Biondi ..... A43B 13/125
2020/0154831 A1 * 5/2020 Hopkins ..... A43B 13/22
2022/0110405 A1 * 4/2022 Megrabyan ..... A43B 7/1415
2024/0373980 A1 * 11/2024 Andrews ..... A43B 13/122

FOREIGN PATENT DOCUMENTS

EP 0 990 397 A1 4/2000
EP 2 106 714 A2 10/2009
JP 2003-339405 A 12/2003

* cited by examiner

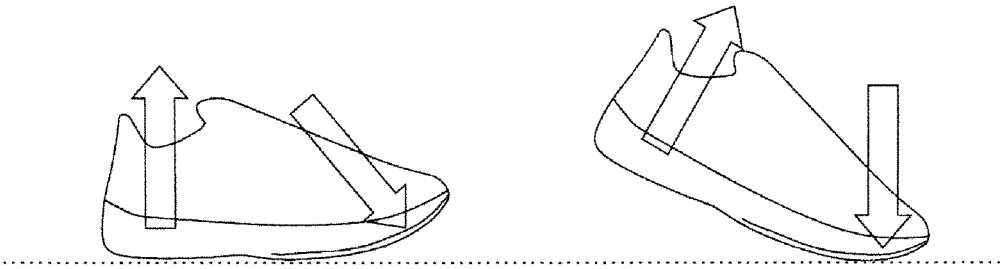
Fig. 1 – Prior Art
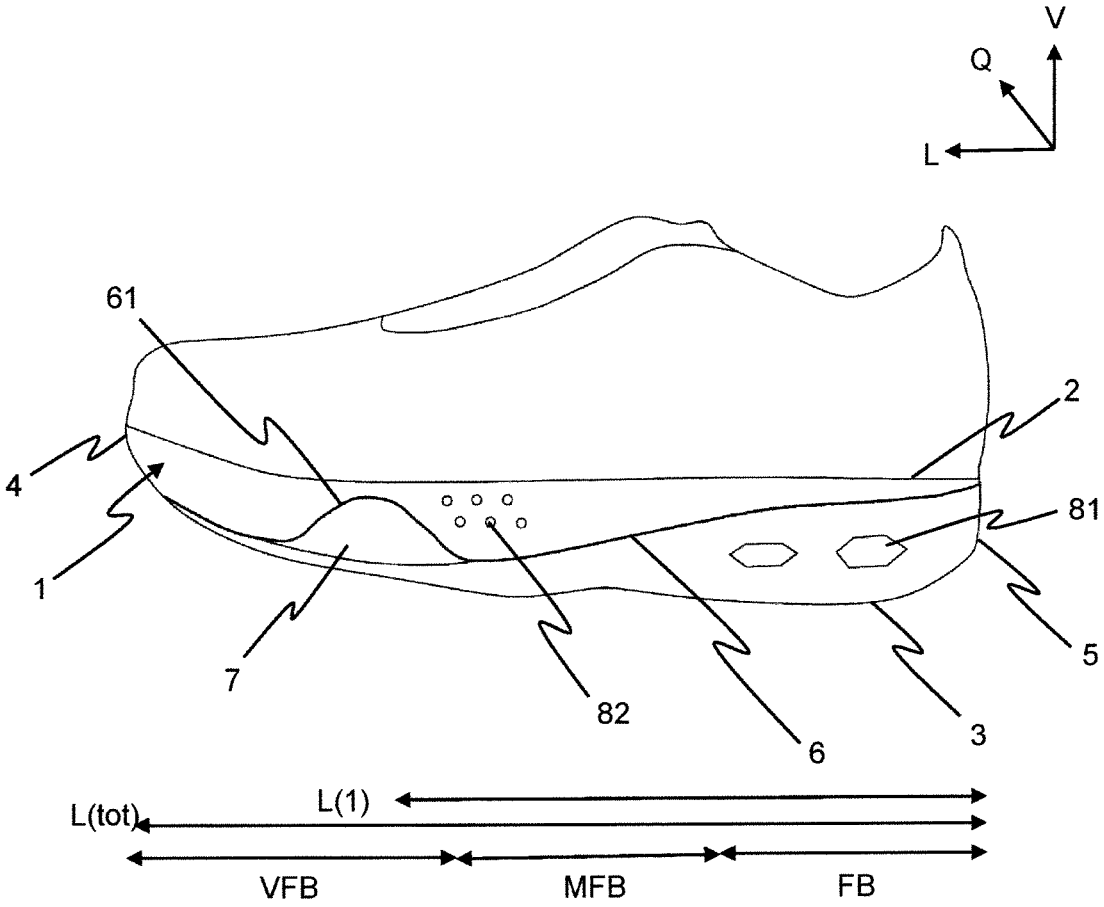
Fig. 2

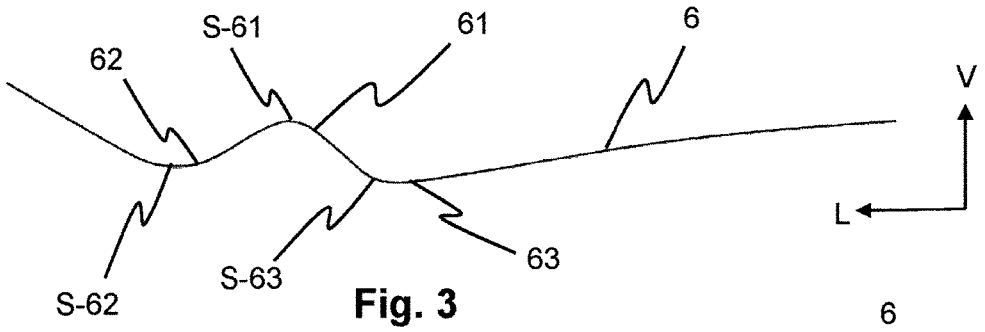
Fig. 3
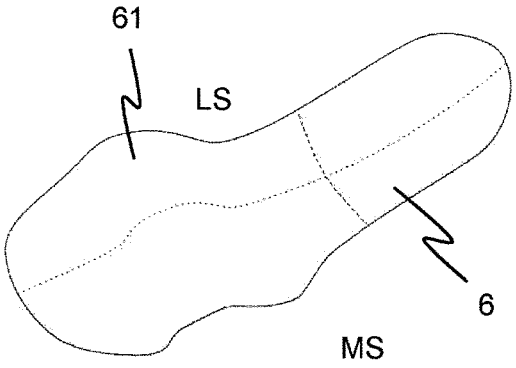
Fig. 4
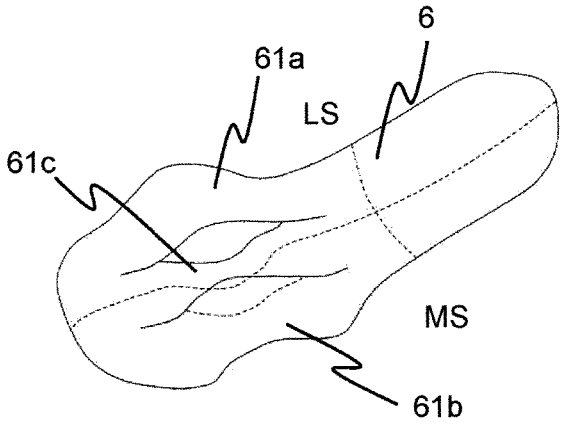
Fig. 6
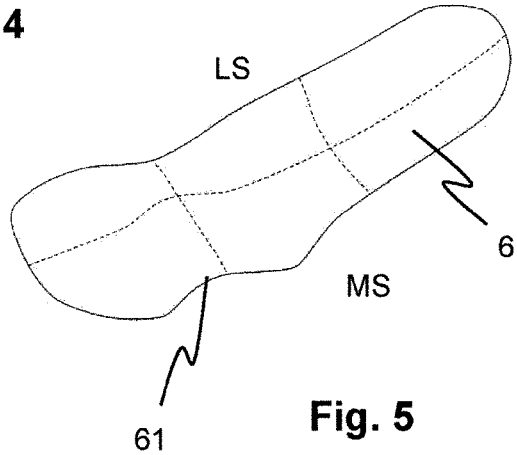
Fig. 5
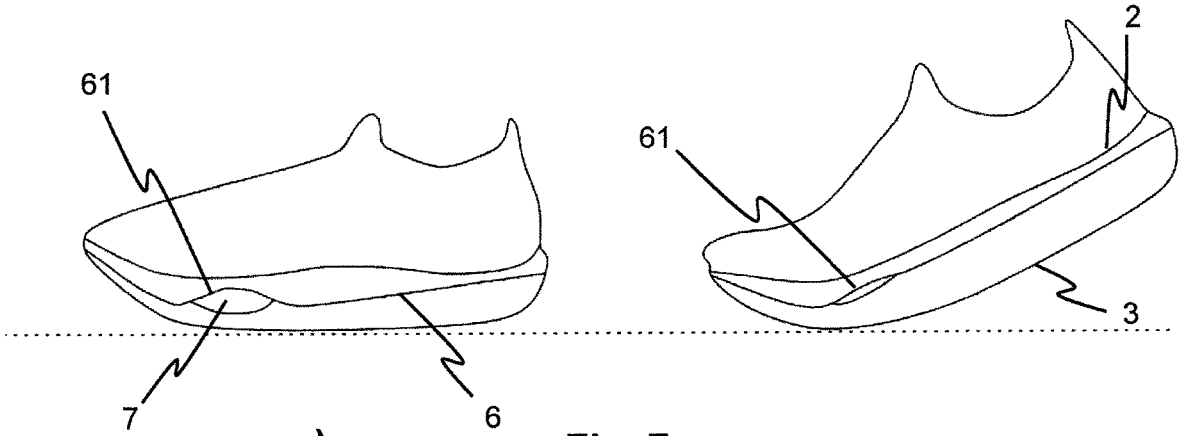
a) Fig. 7 b)

SOLE COMPRISING A CURVED ELASTIC PLATE

CROSS REFERENCE TO RELATED APPLICATION

This application is a National Phase filing in the United States, under 35 USC § 371, of PCT International Patent Application PCT/EP2022/055930, filed on 8 Mar. 2022 which claims the priority of Swiss Patent Application No. 00260/21, filed 10 Mar. 2021 and Swiss Patent Application No. 070364/2021, filed 8 Oct. 2021.

The above-referenced applications are hereby incorporated by reference herein in their entirety and are made a part hereof, including but not limited to those portions which specifically appear hereinafter.

BACKGROUND OF THE INVENTION

Field of the Invention

The present invention relates to a sole with a curved elastic plate for a running shoe.

Discussion of Related Art

In order to reduce the amount of force required by the runner during running, or to delay runner fatigue, prior art midsoles with elastic plates are known. These plates are typically stiffer than the rest of the midsole, which is typically formed from a foamed polymer material. Such plates are arranged in the forefoot region and optionally in the midfoot region. If the runner shifts his weight in the running direction, i.e., in the direction of the sole tip, the plate causes a lifting effect. The force directed towards the ground by the runner's toes in the forefoot region is converted by the plate in the heel region into a force directed against the ground, thus supporting the push-off process.

In other embodiments, elastic plates are bent in the direction of the ground during treading and the rolling movement and are thus strained. Due to the elastic properties of the plate, it returns to its original flat shape when the foot pushes off from the ground, thus supporting the push-off and saving force.

SUMMARY OF THE INVENTION

The soles known from the prior art can only use a relatively small part of the forces acting on the sole during running for the push-off. It is therefore the general object of the present invention to further develop the prior art in the field of soles for running shoes and preferably to overcome the disadvantages of the prior art in whole or in part. In advantageous embodiments, a sole is provided which allows a higher proportion of the forces acting on the sole during running to be used for push-off than is the case with soles known in the prior art.

In a first aspect, the general object is solved by a sole for a running shoe as claimed and described. The sole has a sole tip and a heel edge, and a midsole having a base surface delimiting the midsole in a direction opposite to the vertical direction of the midsole and a top surface delimiting the midsole in the vertical direction. The midsole has, in the longitudinal direction, a heel region (FB), a midfoot region (MFB), and a forefoot region (VFB). It is understood that the midfoot region is arranged in longitudinal direction directly between the forefoot region and the heel region. The midsole also has an elastic plate, in particular a flexurally elastic plate, which extends at least from the forefoot region into the midfoot region, and optionally into the heel region.

In the forefoot region and/or in the midfoot region, the elastic plate has a first curvature curved along the longitudinal direction of the midsole in the direction of the top surface of the midsole and having a vertex. The elastic plate, in particular the first curvature, is configured such that the first curvature is elastically bent in the direction of the base surface by the forces acting during treading and/or rolling movement, and the curvature returns to its original shape during push-off. In other words, the curvature is flattened during treading. As the wearer's foot flexes during the rolling movement, with the heel lifting off the ground in the vertical direction and the forefoot region, and in particular the toes, remaining in contact with the ground, the first curvature can be bent in the direction of the base surface. This bending is not limited to bending exclusively in the vertical direction, but can also occur at least partially in or against the longitudinal direction. This effect is also caused by the weight of the wearer during treading. This causes the plate to be strained. Since the plate is elastic, it returns to its original shape when the sole is pushed-off from the ground, thus assisting the push-off process and reducing the amount of force required by the runner, so that the runner tires less quickly.

Alternatively, the elastic plate in the forefoot region and/or in the midfoot region has a first curvature curved along the longitudinal direction of the midsole in the direction of the base surface of the midsole and having a vertex. The elastic plate is configured such that the first curvature is elastically bent in the direction of the top surface by the forces acting during treading and/or rolling movement and the first curvature returns to its original shape during push-off.

The original shape refers to the plate in the state before contact of the sole with the ground, or the unloaded state. In the region of the main channel, the base surface of the midsole acts like a bowstring, i.e., it is strained when the curvature is compressed and stores additional energy, which causes contraction when the plate is relieved and bends the curvature back to its original position.

Directional indications as used in the present disclosure are to be understood as follows: The longitudinal direction L of the sole is described by an axis from the heel region to the forefoot region, and thus extends from the heel edge to the sole tip along the longitudinal axis of the sole. The transverse direction Q of the sole is transverse to the longitudinal axis and substantially parallel to the underside of the sole, or substantially parallel to the ground in the operative state. Thus, the transverse direction extends along a transverse axis of the midsole. In the context of the present invention, the vertical direction or vertical direction V refers to a direction from the underside of the sole towards the insole, or in the operative state towards the foot of the wearer, and thus runs along a vertical axis of the sole, or midsole. The lateral side of the sole is the outer perimeter of the sole, which in the worn state rests against the outer instep of the wearer's foot. The medial side of the sole, or midsole, is the outer inner boundary of the sole, which is arranged opposite the lateral side. Thus, in a pair of running shoes, the medial sides of the two running shoes face each other and the lateral sides face away from each other when worn. For example, the forefoot region extends from the sole tip opposite the longitudinal direction to 30-45% of the total length of the midsole in the longitudinal direction. The heel region extends, for example, from the heel edge in the longitudinal direction to 20-30% of the total length of the midsole in the longitudinal direction. The midfoot region extends directly between the heel region and the forefoot region, such that the length in the longitudinal direction of the midfoot region constitutes the remaining portion of the total length, particularly from 15-50% of the total length. The sole tip and the heel edge are the outermost limits of the sole in, respectively against, the longitudinal direction.

The skilled person understands that in some embodiments, the base surface and/or the top surface may be curved in cross-section along a cross-sectional plane in the longitudinal direction of the midsole and transverse to the transverse direction of the midsole, in particular convex toward the ground during running.

The skilled person further understands that a "curvature curved along the longitudinal direction of the midsole in the direction of the top surface of the midsole" means that the plate rises along the longitudinal direction in the vertical direction of the sole, as viewed from the heel edge to the vertex of the curvature, and then descends in the vertical direction from the vertex toward the sole tip. Equivalently, a "curvature curved along the longitudinal direction of the midsole in the direction of the base surface of the midsole" means that the plate, as viewed from the heel edge, descends along the longitudinal direction in the vertical direction to the vertex and then rises from the vertex toward the sole tip in the vertical direction.

The skilled person also understands that the terms "first curvature", "second curvature", "third curvature" and "fourth curvature" merely serve to distinguish different curvatures. However, that an embodiment has a fourth curvature, as described herein below, does not necessarily mean that a second and/or a third curvature must also be present. There are certainly embodiments disclosed and comprising, for example, a first curvature and a fourth curvature as described herein, but, for example, no second curvature. Consequently, the terms "first curvature", "second curvature", "third curvature" and "fourth curvature" could also be replaced by "curvature A", "curvature B", "curvature C" and "curvature D".

In some embodiments, the first curvature extends end-to-end in the transverse direction from the medial side of the sole to the lateral side of the sole. Alternatively, the first curvature may be arranged only on the medial side or only on the lateral side of the sole. In such embodiments, the first curvature may decline from the medial side along the transverse direction of the sole in the vertical direction. Conversely, the first curvature may decline from the lateral side along the transverse direction of the sole in the vertical direction. In particular, the plate may then have no curvature on the respective other side. In such embodiments, the main channel may in particular be formed as a blind hole, or blind hole.

In cross-section along the longitudinal direction and perpendicular to the transverse direction in the view of the medial-side of the sole, the first curvature in the course from the heel edge to the sole tip can be described first as a curve with a clockwise curvature up to a first inflection point, then as a curve with a counterclockwise curvature up to a second inflection point, and subsequently as a curve with a clockwise curvature.

In the region of the first curvature, in some embodiments, the plate may have a maximum thickness of three times, preferably a maximum thickness of twice, more preferably a maximum thickness of 1.5 times, more preferably a maximum thickness of the same, more preferably a maximum thickness of 0.5 times, as in other regions of the plate.

The elastic plate is typically as such incompressible.

In some embodiments, the sole may comprise further components, such as an abrasion-resistant outsole, which is attached to the base surface of the midsole, preferably in a fabric-locking manner, and which may in particular have a profile to prevent slipping during running, in particular during push-off. The sole may also have an insole attached to the top surface of the midsole.

In some embodiments, the midsole comprises an elastic polymer material, in particular a soft elastic polymer material, preferably a polymer foam. This typically makes up the majority of the weight and volume of the midsole. In certain embodiments, the midsole comprises the elastic plate and the elastic, particularly soft elastic, polymer material, preferably a polymer foam. The plate is typically more flexurally rigid than the elastic, in particular soft elastic, polymer material.

Suitable elastic, in particular soft elastic, materials are sufficiently known to the skilled person as materials for the midsole. For example, materials having a Young's modulus of about 0.0001 to 0.2 GPa, more particularly 0.001 to 0.1 GPa, may be used, which may be considered an elastic, or soft elastic, material for the purposes of the present invention. Typically, such materials may comprise polymer foams. Polyurethane, in particular thermoplastic polyurethane (TPU) or expanded thermoplastic polyurethane (eTPU), polyamides, e.g. PA-11, PA-12, nylon, polyether block amide (PEBAX®), polyethylene terephthalate (PET) or polybutylene terephthalate (PBT), polyolefins, in particular ethylene-vinyl acetate copolymer (EVA), or mixtures thereof, may be used as elastic, or as soft elastic, materials.

The material of the elastic plate can be selected from thermoplastic polyurethane, polyolefin, in particular polyethylene and polypropylene, polyester, polyester elastomers, polyamide, polyether block amide, carbon and mixtures thereof.

The elastic plate can additionally comprise reinforcing fibers to increase the stiffness and thus the energy available for the push-off. These can be selected, for example, from linen, basalt, aramid, bamboo, hemp, cellulose, glass, palm, carbon fibers and mixtures thereof.

In some embodiments, the midsole, and therefore in particular the elastic plate, has only a single curvature curved along the longitudinal direction of the midsole in the direction of the top surface of the midsole. Although this may be subdivided in the transverse direction of the midsole, in such embodiments there is no further curvature of the plate arranged longitudinally in front of or behind the curvature, which is curved along the longitudinal direction of the midsole in the direction of the top surface of the midsole. However, this does not mean that there cannot be further curvatures which are curved in the direction of the base surface. It has been shown that embodiments with a single such curvature are optimal for supporting the push-off process because the runner's foot flexes primarily at the metatarsophalangeal joints. Similarly, in embodiments having a plate with a first curvature curving in the direction of the base surface of the midsole, the midsole, and therefore in particular the elastic plate, may have only a single curvature curving along the longitudinal direction of the midsole in the direction of the base surface of the midsole. Although this may be subdivided in the transverse direction of the midsole, in such embodiments there is no further curvature of the plate arranged longitudinally in front of or behind the curvature, which is curved along the longitudinal direction of the midsole in the direction of the base surface of the midsole. However, this does not necessarily mean that there cannot be further curvatures which are curved in the direction of the top surface.

In some embodiments, the midsole, and therefore in particular the elastic plate, has only one, or only two, curvatures curving along the longitudinal direction of the midsole in the direction of the top surface of the midsole. Similarly, in embodiments having a plate with a first curvature curving in the direction of the base surface of the midsole, the midsole, and therefore in particular the elastic plate, may have only two curvatures curving along the longitudinal direction of the midsole in the direction of the base surface of the midsole.

In some embodiments, the midsole, and therefore in particular the elastic plate, has only a single curvature in the midfoot region and in the forefoot region curved along the longitudinal direction of the midsole in the direction of the top surface of the midsole. This may be subdivided, or segmented, in the transverse direction of the sole, but in such embodiments there is no further curvature of the plate in the midfoot region and in the forefoot region, arranged in the longitudinal direction in front of or behind the curvature, which is curved along the longitudinal direction of the midsole in the direction of the top surface of the midsole. However, this does not necessarily mean that in the midfoot region and in the forefoot region there cannot be further curvatures which are curved in the direction of the base surface or that in the heel region there is not further, and in particular exactly one, curvature(s) curved in the direction of the base surface or in the direction of the top surface. This is certainly provided in some embodiments. In particular, the curvature in the heel region may be a "fourth curvature" as described herein. It has been shown that embodiments with a single such first curvature are optimal for supporting the push-off process because the runner's foot flexes primarily at the metatarsophalangeal joints. Similarly, in embodiments having a plate with a first curvature curving in the direction of the base surface of the midsole, the midsole, and therefore in particular the elastic plate, may have only a single curvature curving along the longitudinal direction of the midsole in the direction of the base surface of the midsole in the midfoot region and in the forefoot region. Although this may be subdivided in the transverse direction of the sole, in such embodiments there is no further curvature of the plate in the midfoot region and in the forefoot region, arranged in the longitudinal direction in front of or behind the curvature, which is curved along the longitudinal direction of the midsole in the direction of the base surface of the midsole. However, this does not necessarily mean that there cannot be further curvatures which are curved in the direction of the top surface or that further, and in particular exactly one, curvature(s) curved in the direction of the base surface or in the direction of the top surface is/are not provided in the heel region. This is certainly provided in some embodiments. In particular, the curvature in the heel region may be a "fourth curvature" as described herein.

In some embodiments, the plate is arranged between the top surface and the base surface of the midsole, particularly in the midsole. In this regard, apart from the plate, the midsole may be formed in a single piece and/or in two pieces. For example, the plate may completely separate an upper portion and a lower portion of the midsole. The upper portion and the lower portion can be bonded, welded or otherwise materially connected to the plate.

The plate may extend in the longitudinal direction of the sole over at least 50%, in particular at least 75%, in particular at least 85%, in particular at least 90%, or even over 100% of the total length of the midsole.

The plate may extend in the transverse direction of the sole over at least 50%, in particular at least 75%, in particular at least 85%, in particular at least 90%, or even over 100% of the total width of the midsole.

In some embodiments, the thickness of the sheet is in the range of 0.5 mm to 3.0 mm, in particular from 0.8 mm to 1.2 mm.

In some embodiments, the thickness of the plate is not constant over the entire region of the plate, such that the plate is more flexurally rigid in some regions than in other regions.

In some embodiments, the midsole has a main channel extending in the transverse direction, which is formed at least in part by the first curvature curved in the top surface or base surface direction. The plate thus forms at least part of a channel wall of the main channel in the region of the curvature. Such a main channel has the advantage of facilitating the bending of the curvature in the direction of the base surface, or in the direction of the top surface. Preferably, the main channel is empty and/or open on the lateral-side and medial-side. However, it is also possible that the main channel is filled with a material which is softer than the material of the main part of the midsole.

Preferably, the main channel is completely delimited by the midsole in the lateral region of the midsole, with the exception of any lateral-side and/or medial-side openings. In particular, the main channel is completely delimited by the midsole in cross-section along a cross-sectional plane in the longitudinal direction (L) of the midsole and transverse to the transverse direction (Q) of the midsole. In such an embodiment, the channel wall may consequently be formed entirely by the midsole in the lateral region of the midsole. Typically, the main channel in the lateral view of the sole can therefore be described as a transverse opening in a preferably otherwise one-piece midsole.

For the purposes of the present invention, a channel is understood to be a recess which may typically be tubular in shape. Generally, a channel is wholly or partially delimited by its channel walls except at the side openings. Typically, the channels are empty. In particular, the channels may be open and end-to-end, i.e., a channel is not a blind hole in such embodiments. Preferably, one channel, in particular all channels of the midsole, extends end-to-end from the lateral side of the midsole to the medial side of the midsole. In preferred embodiments, the channels, particularly the cushioning channels, may extend substantially parallel to each other. In some embodiments, the total portion of the open region of the midsole, i.e., the total portion of the lateral side of the channel openings, may be less than the total portion of the closed region of the midsole, i.e., the total portion of the outer side of the midsole that does not include channels. In some embodiments, the channels are arranged in series exclusively in the longitudinal direction, i.e., from the heel edge toward the sole tip. This does not preclude the channels from being arranged offset from one another in the vertical direction, however, the channels are therefore neither fully nor partially superimposed in the vertical direction.

It is clear to the person skilled in the art that the deformability of the channels may comprise, for example, the vertical merging of the channel walls and/or the shearing of the channel in the longitudinal direction. Typically, the upper and lower channel walls may contact each other under the effect of the forces occurring during running, so that the corresponding channel, in particular the corresponding cushioning channel, is deformed to the point of lateral closure.

In some embodiments, the main channel extends end-to-end in the transverse direction from the medial side of the midsole to the lateral side of the midsole and is preferably open on the medial side and lateral side.

In some embodiments, the open region of the main channel on the medial side and/or lateral side of the sole is 2 cm2 to 20 cm2, preferably, between 7 cm2 to 13 cm2.

In some embodiments, the first curvature is bell-curve-shaped in cross-section along the longitudinal direction of the midsole and perpendicular to the transverse direction of the midsole. Such a curvature has been found to be advantageous because the force generated during rolling movement and treading can be efficiently absorbed not only in the vertical direction, but also against the longitudinal direction, and briefly stored by correspondingly bending the curvature in the direction of the base surface, or in the direction of the top surface. This provides better support for the push-off.

In some embodiments, the first curvature, in particular the vertex of the first curvature, is arranged such that the first curvature, or its vertex, is arranged below or longitudinally in front of the metatarsophalangeal joints of the wearer in the operative state. In longitudinal direction in front of the metatarsophalangeal joints means that the first curvature is arranged between the sole tip and the metatarsophalangeal joints. Since the wearer's foot mainly flexes at the metatarsophalangeal joints, this allows a high amount of energy to be stored in the plate during treading and rolling movement and released during push-off, reducing wearer fatigue.

In some embodiments, the vertex of the first curvature from the heel edge of the sole from the direction of the sole tip is arranged at 50% to 75%, particularly 60% to 70%, of the total length in the longitudinal direction of the sole. The skilled person understands that the total length of the sole denotes the extension in longitudinal direction from the heel edge to the sole tip. This ensures, at least in a majority of the population, that the curvature is arranged in the region of the metatarsophalangeal joints, in particular below or in front of the metatarsophalangeal joints, of the wearer. Alternatively, however, it is possible for the wearer's foot to be analyzed and measured first and for the first curvature to be arranged individually during manufacture.

In some embodiments, the first curvature at the vertex in cross-section along the longitudinal direction and perpendicular to the transverse direction has a vertex radius of 1 mm to 200 mm, particularly 5 mm to 50 mm, especially 20 to 30 mm. The skilled person understands that the vertex radius describes the radius of the circle of curvature, i.e., that circle which best approximates the curve at the vertex. Such a vertex radius increases the bending resistance of the first curvature, making more energy available during push-off.

In some embodiments, the elastic plate has one or more, in particular exactly two, planar sections arranged offset in transverse direction to the first curvature. A planar section is generally a section of the elastic plate which, particularly along the longitudinal direction, has no curvature, or is not curved, but is planar. In particular, the at least one planar section may be generally substantially parallel to the top surface and/or parallel to the base surface. Thus, the at least one planar section may extend generally exclusively in the longitudinal direction and in the transverse direction, but may not have an inclination in the vertical direction. Such a planar section can thereby, on the one hand, increase stability during treading and, on the other hand, serve to secure the elastic polymer material, in particular by joining the section to the elastic polymer material by means of a material bond.

In some embodiments, in addition to the first curvature curved in the direction of the top surface of the midsole, the elastic plate includes a second curvature curved along the longitudinal direction of the midsole in the direction of the base surface of the midsole and having a vertex. This second curvature is arranged in the longitudinal direction between the first curvature and the sole tip. In cross-section along the longitudinal direction and perpendicular to the transverse direction of the sole, the plate may be sinusoidal in the region of the first curvature and the second curvature in certain embodiments. In contrast to the first curvature, the second curvature is curved in the direction of the base surface, i.e., the vertex of the second curvature is arranged in the direction of the base surface. Such a second curvature reduces the stiffness of the plate in the region of the curvature and thus, due to the arrangement of the second curvature, facilitates the bending of the first curvature during treading and rolling movement, thereby increasing the energy supporting the push-off.

In some embodiments, the second curvature has a vertex radius in cross-section along the longitudinal direction and perpendicular to the transverse direction of from 5 mm to 1000 mm, particularly from 5 mm to 300 mm, at its vertex.

In some embodiments, in addition to the first curvature curved in the direction of the top surface of the midsole, the elastic plate has a third curvature curved along the longitudinal direction of the midsole in the direction of the base surface of the midsole and having a vertex. The third curvature is thereby arranged in the longitudinal direction between the heel edge and the first curvature. In cross-section along the longitudinal direction and perpendicular to the transverse direction of the sole, in certain embodiments, the plate may be sinusoidal in the region of the first curvature and the third curvature. Unlike the first curvature, the third curvature, like the second curvature, is curved in the direction of the base surface, i.e., the vertex of the third curvature is arranged in the direction of the base surface. Such a third curvature reduces the stiffness of the plate in the region of the curvature and thus, due to the arrangement of the second curvature, facilitates the bending of the first curvature during treading and rolling movement, thereby increasing the energy supporting the push-off.

In some embodiments, the third curvature has a vertex radius at its vertex of from 5 mm to 1000 mm, particularly from 5 mm to 300 mm.

In some embodiments in which the plate has both a second and a third curvature, the vertex radius of the second curvature and the vertex radius of the third curvature are equal.

In some embodiments, the vertex radius of the second curvature and/or the vertex radius of the third curvature is equal to or less than the vertex radius of the first curvature.

In some embodiments in which the plate has both a second and a third curvature, the distance in the longitudinal direction of the sole between the vertex of the second curvature and the vertex of the third curvature may be from 30 mm to 175 mm, particularly from 40 mm to 90 mm.

In some embodiments in which the plate has both a second and a third curvature, the distance in the longitudinal direction of the sole between the vertex of the second curvature and the vertex of the third curvature may be 10% to 60%, particularly 13% to 30%, of the total length of the sole in the longitudinal direction.

In some embodiments in which the plate has a second curvature, the distance in the longitudinal direction of the sole between the vertex of the first curvature and the vertex of the second curvature may be from 40 mm to 175 mm, particularly from 60 mm to 132 mm.

In some embodiments in which the plate has a second curvature, the distance in the longitudinal direction of the sole between the vertex of the first curvature and the vertex of the second curvature may be 13% to 60%, particularly 20% to 45%, of the total length of the sole in the longitudinal direction.

In some embodiments, the elastic plate has a lower stiffness at the second curvature and/or at the third curvature than at the remainder of the plate.

A lower stiffness at the second curvature and/or at the third curvature can be achieved, for example, by the plate having a smaller thickness at the second curvature and/or at the third curvature than at the rest of the plate. Furthermore, lower stiffness can be achieved by specifically selecting the respective vertex radius of the vertex of the second curvature and/or the third curvature. In addition, the rest of the plate, in contrast to the second and/or the third curvature, can be reinforced with reinforcing fibers to increase the stiffness.

In some embodiments, the vertex of the first curvature is arranged to be offset from the vertex of the second curvature and/or from the vertex of the third curvature in the vertical direction by 5 mm to 30 mm, in particular by 10 mm to 20 mm.

In some embodiments, the first curvature curved in the direction of the top surface of the midsole includes a lateral-side curvature curved along the longitudinal direction of the midsole in the direction of the top surface of the midsole and a medial-side curvature separate therefrom, arranged in a transverse direction and curved along the longitudinal direction of the midsole in the direction of the top surface of the midsole. The first curvature is thus divided into a lateral-side curvature and a medial-side curvature. Both the medial-side and lateral-side curvatures are curved along the longitudinal direction of the midsole toward the top surface of the midsole, as described earlier for the first curvature. The medial-side and lateral-side curvatures are typically spatially separated and/or independently movable. The medial-side and lateral-side curvatures may be identical along the longitudinal direction, i.e., they may have the same inclination in the longitudinal direction. Typically, the lateral-side curvature and the medial-side curvature are not offset from each other in the longitudinal direction. Such embodiments have, among other things, the advantage that the first curvature is more flexible due to the subdivision in transverse direction, which is advantageous depending on the wearer's rolling movement style, since some runners roll more medial-side and others more lateral-side.

Alternatively, the first curvature curved in the direction of the base surface of the midsole may have a lateral-side curvature curved along the longitudinal direction of the midsole in the direction of the base surface of the midsole and a medial-side curvature separate therefrom, arranged offset in the transverse direction and curved along the longitudinal direction of the midsole in the direction of the base surface of the midsole. The first curvature is thus divided into a lateral-side curvature and a medial-side curvature. Both the medial-side and lateral-side curvatures are curved along the longitudinal direction of the midsole in the direction of the base surface of the midsole, as described earlier for the first curvature. The medial-side and lateral-side curvatures are typically spatially separated and/or independently movable. The medial-side and lateral-side curvatures may be identical along the longitudinal direction, i.e., they may have the same inclination in the longitudinal direction. Typically, the lateral-side curvature and the medial-side curvature are not offset from each other in the longitudinal direction. Such embodiments have, among other things, the advantage that the first curvature is more flexible due to the subdivision in transverse direction, which is advantageous depending on the wearer's rolling movement style, since some runners roll more medial-side and others more lateral-side.

In some embodiments, an intermediate curvature curved along the longitudinal direction of the midsole in the direction of the base surface of the midsole is arranged between the medial-side curvature curved in the direction of the top surface of the midsole and the lateral-side curvature curved in the direction of the base surface of the midsole. The intermediate curvature is curved in the direction of the base surface of the midsole, in contrast to the first curvature, or the medial-side and lateral-side curvatures. Thus, the vertex of the medial-side and lateral-side curvature is arranged in the direction of the top surface, while the vertex of the intermediate curvature is arranged in the direction of the base surface. While the medial-side and lateral-side curvatures are bent in the direction of the base surface, as already described above for the first curvature, in order to store energy temporarily and release it during push-off and therefore support this, the intermediate curvature can act as a spring and thus also support the push-off. During treading and rolling movement, the medial-side and lateral-side curvature and the intermediate curvature are therefore bent in such a way that they move towards each other in vertical direction. They then return to their original shape during push-off.

In cross-section along the longitudinal direction and perpendicular to the transverse direction in the view of the medial-side of the sole, the intermediate curvature can be described in the course from the heel edge to the sole tip first as a curve with a counterclockwise curvature up to a first inflection point, then as a curve with a clockwise curvature up to a second inflection point, and subsequently as a curve with a counterclockwise curvature.

In some embodiments, a planar section is arranged in the transverse direction between the medial-side curvature curved in the direction of the base surface of the midsole and the lateral-side curvature curved in the direction of the base surface of the midsole, which planar section is arranged substantially parallel to the surface and/or parallel to the base surface, in particular along the longitudinal direction of the midsole. Such a planar section can, on the one hand, increase stability during treading and, on the other hand, serve to secure the elastic polymer material, in particular by bonding the section to the elastic polymer material.

In some embodiments, the first curvature, and optionally the second and/or the third curvature and/or the lateral-side curvature and/or the medial-side curvature, is segmented, or subdivided, into curvature segments that are separate from one another and arranged offset in the transverse direction. Curvature segments separated from one another can be moved and/or deformed, in particular bent, independently of one another. Typically, some, and in particular all, curvature segments have the same length, i.e., the same extension in longitudinal direction L. However, it is possible that the curvature segments within the first curvature have a different height, i.e., extension in vertical direction or an identical height.

Each of the curvature segments may have a width, i.e., an extension in the transverse direction, of from 4 mm to 50 mm, in particular from 9 mm to 22 mm.

The first curvature may thereby comprise at least 3, in particular at least 4, in particular at least 5 such curvature segments. Preferably, the first curvature comprises 3 to 9, in particular 3-7, in particular 3-5, such curvature segments.

In some embodiments, each curvature segment is curved independently of the other curvature segments along the longitudinal direction toward the top surface of the midsole or curved along the longitudinal direction toward the base surface of the midsole. Preferably, either all of the curvature segments may be curved along the longitudinal direction toward the top surface of the midsole, or all of the curvature segments may be curved along the longitudinal direction toward the base surface of the midsole.

In some embodiments, the first curvature comprises an odd number n of curvature segments. Preferably, at least (n+1)/2 curvature segments are curved in the direction of the base surface of the midsole and optionally (n−1)/2 curvature segments are curved in the direction of the top surface of the midsole. In some embodiments, in the transverse direction Q, the curvature segments curved in the direction of the base surface of the midsole may be arranged alternately with the curvature segments curved in the direction of the top surface of the midsole. Alternatively, in some embodiments, all of the curvature segments of the first curvature may be curved in the direction of the base surface of the midsole and, in addition, a planar section is arranged between all of the adjacent curvature segments. As discussed above, the planar section may be substantially parallel to the top surface and/or parallel to the base surface. Thus, the section may extend exclusively in the longitudinal direction and in the transverse direction, but may not have an inclination in the vertical direction.

For example, it is possible for the first curvature to have five curvature segments. Of these five curvature segments, three are curved in the direction of the base surface of the midsole. These three curvature segments are a lateral-side curvature segment, a medial-side curvature segment, and a central curvature segment arranged therebetween. Between the central curvature segment and the lateral-side curvature segment, which are each curved in the direction of the base surface of the midsole, another curvature segment curved in the direction of the top surface of the midsole or a planar section is arranged. Between the central curvature segment and the medial-side curvature segment, which are each curved in the direction of the base surface of the midsole, a further curvature segment curved in the direction of the top surface of the midsole or a further planar section is also arranged.

In some embodiments, at least two curvature segments, and in particular all curvature segments, are directly adjacent in the transverse direction. This means that the respective curvature segments are adjacent to each other and separated only by a gap, but that no structure of the elastic plate, such as further curvature segments or even planar sections, is arranged between the respective curvature segments. Such a gap may, for example, have a width of >0 mm to 1.5 mm, in particular 0.5 mm to 1.0 mm. Such a gap is typically designed to avoid friction between two adjacent curvature segments. In some embodiments, a planar section is arranged between two adjacent curvature segments. In particular, such a planar section of the elastic plate may be arranged along the longitudinal direction of the midsole substantially parallel to the top surface and/or parallel to the base surface. In some embodiments with a number of n curvature segments, n−1 such planar sections are present, each arranged between two adjacent curvature segments.

For example, it is possible for the first curvature to have three curvature segments, each of which is curved in the direction of the base surface of the midsole. The three curvature segments are a lateral-side curvature segment, a medial-side curvature segment, and a central curvature segment arranged therebetween in the transverse direction. A planar section is arranged between the lateral-side curvature segment and the central curvature segment, and another planar section is arranged between the medial-side curvature segment and the central curvature segment. As explained above, the planar section may be substantially parallel to the top surface and/or parallel to the base surface. Thus, the section may extend exclusively in longitudinal direction and in transverse direction, but may not have an inclination in the vertical direction.

In some embodiments, the elastic plate in the heel region has a fourth curvature curved along the longitudinal direction of the midsole toward the top surface of the midsole and having a vertex. In this case, the elastic plate is configured such that the fourth curvature is elastically bent in the direction of the base surface by the forces acting during treading and/or rolling movement, and the fourth curvature returns to its original shape during push-off. Alternatively, the elastic plate in the heel region may have a fourth curvature curved along the longitudinal direction of the midsole in the direction of the base surface of the midsole and having a vertex. In this case, the elastic plate is configured such that the fourth curvature is elastically bent in the direction of the top surface by the forces acting during treading and/or rolling movement and the fourth curvature returns to its original shape during push-off.

Consequently, in such embodiments, in addition to the curvature in the forefoot region and/or midfoot region, another such curvature is provided in the heel region, which also supports the push-off and also has a cushioning effect.

In embodiments having such a fourth curvature, the fourth curvature may have the same features as described above for the first curvature.

For example, the fourth curvature may include a lateral-side curvature curved along the longitudinal direction of the midsole in the direction of the base surface of the midsole and a medial-side curvature separate therefrom, arranged in a transverse direction and curved along the longitudinal direction of the midsole in the direction of the base surface of the midsole. The fourth curvature is thus divided into a lateral-side curvature and a medial-side curvature. Both the medial-side and lateral-side curvatures are curved along the longitudinal direction of the midsole toward the base surface of the midsole, as described earlier for the fourth curvature. The medial-side and lateral-side curvatures are typically spatially separated and/or independently movable. The medial-side and lateral-side curvatures may be identical along the longitudinal direction, i.e., they may have the same inclination in the longitudinal direction. Typically, the lateral-side curvature and the medial-side curvature are not offset from each other in the longitudinal direction. Such embodiments have the advantage, among others, that the fourth curvature is more flexible due to the subdivision in transverse direction, which is advantageous depending on the running style of the wearer, since some runners perform and/or roll more medial-side and others more lateral-side.

Alternatively, the fourth curvature curved in the direction of the top surface of the midsole has a lateral-side curvature curved along the longitudinal direction of the midsole in the direction of the top surface of the midsole and a medial-side curvature separate therefrom, arranged offset in the transverse direction and curved along the longitudinal direction of the midsole in the direction of the top surface of the midsole. The fourth curvature is thus divided into a lateral-side curvature and a medial-side curvature. Both the medial-side and lateral-side curvatures are curved along the longitudinal direction of the midsole toward the top surface of the midsole, as described earlier for the fourth curvature. The medial-side and lateral-side curvatures are typically spatially separated and/or independently movable. The medial-side and lateral-side curvatures may be identical along the longitudinal direction, i.e., they may have the same inclination in the longitudinal direction. Typically, the lateral-side curvature and the medial-side curvature are not offset from each other in the longitudinal direction. Such embodiments have the advantage, among others, that the fourth curvature is more flexible due to the subdivision in transverse direction, which is advantageous depending on the running style of the wearer, since some runners perform and/or roll more medial-side and others more lateral-side.

In some embodiments, a planar section is arranged in the transverse direction between the medial-side curvature curved in the direction of the base surface of the midsole and the lateral-side curvature curved in the direction of the base surface of the midsole, which planar section is arranged substantially parallel to the surface and/or parallel to the base surface, in particular along the longitudinal direction of the midsole. Such a planar section can, on the one hand, increase stability during treading and, on the other hand, serve to secure the elastic polymer material, in particular by bonding the section to the elastic polymer material.

In some embodiments, the fourth curvature is segmented into separate curvature segments arranged offset from one another in the transverse direction. Each of the curvature segments of the fourth curvature may have a width, i.e., a transverse direction dimension, of from 9 mm to 25 mm, particularly from 12 mm to 20 mm.

Typically, some and in particular all curvature segments of the fourth curvature have the same length, i.e., the same extension in longitudinal direction L. However, it is possible that the curvature segments within the fourth curvature have a different height, i.e., extension in vertical direction.

The fourth curvature may thereby comprise at least 3, in particular at least 4, in particular at least 5 such curvature segments. Preferably, the fourth curvature comprises 3 to 9, in particular 3-7, in particular 3-5, such curvature segments.

In some embodiments, each curvature segment is curved independently of the other curvature segments along the longitudinal direction toward the top surface of the midsole or curved along the longitudinal direction toward the base surface of the midsole. Preferably, either all of the curvature segments may be curved along the longitudinal direction toward the top surface of the midsole, or all of the curvature segments may be curved along the longitudinal direction toward the base surface of the midsole. In some embodiments, the curvature segments of a curvature, in particular the first and/or the fourth curvature, are separated from each other by a gap. Such a gap may, for example, have a width of >0 mm to 1.5 mm, in particular 0.5 mm to 1.0 mm. Such a gap is typically designed to avoid friction between two adjacent curvature segments.

In some embodiments, the fourth curvature comprises an odd number n of curvature segments. Preferably, at least (n+1)/2 curvature segments are curved in the direction of the base surface of the midsole and optionally (n−1)/2 curvature segments are curved in the direction of the top surface of the midsole. In some embodiments, in the transverse direction Q, the curvature segments curved in the direction of the base surface of the midsole may be arranged alternately with the curvature segments curved in the direction of the top surface of the midsole.

For example, it is possible for the fourth curvature to have three curvature segments, all of which are curved in the direction of the base surface of the midsole. These three curvature segments are a lateral-side and a medial-side curvature segment and a central curvature segment arranged in between. The three curvature segments can be arranged directly adjacent to each other.

In some embodiments, at least two curvature segments, and in particular all curvature segments, are directly adjacent in the transverse direction. This means that the respective curvature segments are adjacent to each other and separated only by a gap, but that no structure of the elastic plate, such as further curvature segments or even planar sections, is arranged between the respective curvature segments. Such a gap may, for example, have a width of >0 mm to 1.5 mm, in particular 0.5 mm to 1.0 mm. Such a gap is typically designed to avoid friction between two adjacent curvature segments. In some embodiments, a planar section is arranged between two adjacent curvature segments. In particular, such a planar section of the elastic plate may be arranged along the longitudinal direction of the midsole substantially parallel to the top surface and/or parallel to the base surface. In some embodiments with a number of n curvature segments, n−1 such planar sections are present, each arranged between two adjacent curvature segments.

In some embodiments, the sole includes only a first curvature according to one of the embodiments described herein and a fourth curvature according to one of the embodiments described herein. In such embodiments, the sole does not comprise any other curvatures. Preferably, the first curvature is thereby arranged in the forefoot region and optionally in the midfoot region, and the fourth curvature is preferably arranged in the heel region and optionally in the midfoot region. The first curvature and the fourth curvature can thereby be arranged offset in longitudinal direction to the fourth curvature. Thus, a curvature-free section is arranged between the first curvature and the fourth curvature. This can thereby have through-holes as described below.

In some embodiments, the elastic plate defines a plurality of through-holes extending vertically through the elastic plate. These through-holes may be arranged in the heel region and/or the forefoot region and/or the midfoot region. Typically, the through-holes are arranged outside of the first, second, third and/or fourth curvatures. In some embodiments, such through-holes are arranged end-to-end in the longitudinal direction in front of and/or behind the first, second, third, and/or fourth curvatures. Such holes increase the lifetime of the elastic plate by preventing cracking.

In some embodiments, the elastic plate has a flexural modulus, measured by the test method 1 described herein, of from 53 GPa to 81 GPa, particularly from 60 GPa to 70 GPa. Such a flexural modulus provides a strong propelling force in the running direction, but at the same time allows good cushioning. These values refer to a measurement of the elastic plate per se, i.e., without further sole materials, such as polymer foam components or the like.

According to test procedure 1, a 3-point bending test is performed (for the 3-point bending test, see https://en.wikipedia.org/wiki/Three-point_flexural_test and DIN EN ISO 178:2019). For this purpose, an elastic plate is placed with its base surface on two support pins that extend over the entire transverse direction of the elastic plate. The elastic plate used can usually be an elastic plate for a size 10 shoe and have a length of 262 mm. The two support pins are arranged at a distance of 180 mm from each other. Each support pin has a width (extending in the transverse direction of the sole unit during measurement) of 50 mm and has a rounded edge with a curve radius of 2 mm that supports the elastic plate. Then a loading pin is arranged on the top layer at the point where the width of the elastic plate, i.e., the transverse direction extension, reaches its maximum. The loading pin has a width (extension in the transverse direction of the elastic plate during measurement) of 50.4 mm and a rounded semi-cylindrical edge that presses on the elastic plate with a diameter of 10 mm. The loading pin is arranged in the longitudinal direction between the two support pins. The front support pin, i.e., the support pin closer to the tip of the elastic plate, is spaced 60 mm from the loading pin in the longitudinal direction; and the rear support pin, i.e., the support pin closer to the heel edge of the elastic plate, is spaced 120 mm from the loading pin in the longitudinal direction. Then, the loading pin is preloaded with a force of 10 N ($F_0$) and then gradually loaded with a force that deflects the elastic plate, and the force ($F_1$) required to deflect the elastic plate by 10 mm in the vertical direction is measured (test speed: 50 mm/min). The formula $E=l^3_v\Delta F/(_4D_L\ ba^3)$ can be used to determine the flexural modulus, where ΔF is the difference in Newtons between the end of the measurement ($F_1$) and the beginning of the measurement ($F_0$); $l_v$ is the span in mm; $D_L$ is the bending distance between $F_1$ and $F_0$ in mm; b is the width of the specimen at the loading pin position in mm; and a is the thickness of the specimen at the loading pin position in mm.

In some embodiments, the midsole has a plurality of cushioning channels running in the transverse direction, in particular arranged one behind the other in the longitudinal direction. In a preferred embodiment, the cushioning channels have lateral openings in the lateral region of the midsole. Preferably, the cushioning channels are deformable vertically and/or horizontally in the longitudinal direction under the action of forces acting vertically and/or in the longitudinal direction and occurring during running until the lateral openings are closed. Such channels increase the cushioning of the sole during treading. In preferred embodiments, the cushioning channels are not blind holes, but end-to-end. The cushioning channels are preferably arranged in the heel region and optionally in the midfoot region and/or in the forefoot region. Typically, the upper and lower channel walls of a cushioning channel can contact each other under the effect of the forces occurring during running.

In some embodiments, the cushioning channels have along the cross-sectional plane in the longitudinal direction of the midsole and perpendicular to the transverse direction of the midsole each a pentagonal, hexagonal and/or drop-shaped, in particular lancet-shaped, contour. It is also possible for one or more cushioning channels of the midsole to have a different contour than other cushioning channels of the midsole. In particular, the midsole can have up to 5 cushioning channels with different contours. A drop-shaped contour refers to a shape which is essentially characterized by an isosceles triangle and a circular segment connected thereto. The skilled person understands that these contours also include shapes with rounded corners, i.e., for example, a rectangle with rounded corners. A drop-shaped contour is particularly preferred in this respect, especially if the part of the circular segment of the drop shape is oriented towards the base surface of the sole which faces the ground. In this way, a particularly large horizontal cushioning of forces acting in the horizontal direction during running can be achieved. Furthermore, a drop-shaped contour allows a particularly controlled closure of the channels, so that a floating effect is avoided.

In some embodiments, the lateral-side and/or medial-side open region of a, or each, individual cushioning channel is smaller than the lateral-side and/or medial-side open region of the main channel.

In some embodiments, the cushioning channels are arranged one behind the other in the longitudinal direction from the heel edge to the sole tip of the sole, and at least two or more cushioning channels are arranged offset from each other in the vertical direction. In certain embodiments, the cushioning channels are arranged in the lateral and/or medial region of the midsole in at least a first and a second horizontal plane. In this case, the first and second horizontal planes are formed vertically offset from one another. By arranging the cushioning channels in at least one first and one second horizontal plane, a significant improvement in the cushioning effect is achieved. In addition, the cushioning is no longer limited to individual regions of the sole, but extends essentially over the entire midsole.

A horizontal plane of the sole describes a plane which is oriented essentially parallel to the underside of the sole, or essentially parallel to the ground. It is also understood that the horizontal plane may also be slightly curved. This can be the case, for example, if the sole is slightly curved upwards vertically at the forefoot region and/or at the heel region, as is typical for running shoes.

Another aspect of the invention relates to a running shoe comprising a sole according to any of the embodiments described herein.

Another aspect of the invention relates to an elastic plate according to one of the embodiments described herein, in particular the embodiments of the first aspect of the invention. This aspect of the invention relates to an elastic plate as such. It is understood that a curvature curved or curved in the direction of the base surface in this case corresponds to a curvature curved or bent in the negative vertical direction, and a curvature curved or bent in the direction of the top surface in this case corresponds to a curvature curved or bent in the positive vertical direction.

Another aspect of the invention relates to a use of an elastic plate according to one of the embodiments of the above aspect of the invention for a shoe or for a sole of a shoe.

BRIEF DESCRIPTION OF SEVERAL VIEWS OF THE DRAWINGS

Aspects of the invention are explained in more detail with reference to the embodiments shown in the following figures and the accompanying description.

FIG. 1 schematically shows the principle of soles with plates known from prior art;

FIG. 2 shows a schematic side view of a running shoe with a sole according to a further embodiment of the invention;

FIG. 3 shows a cross-section of a plate for a plate for a sole according to an embodiment of the invention;

FIG. 4 shows schematically a view of a plate for a sole according to an embodiment of the invention;

FIG. 5 shows schematically a view of a plate for a sole according to a further embodiment of the invention;

FIG. 6 shows schematically a view of a plate for a sole according to a further embodiment of the invention;

FIG. 7*a* shows schematically the principle of the sole according to an embodiment of the invention;

FIG. 7*b* shows schematically the principle of the sole according to an embodiment of the invention;

DETAILED DESCRIPTION OF THE INVENTION

Figure 8:
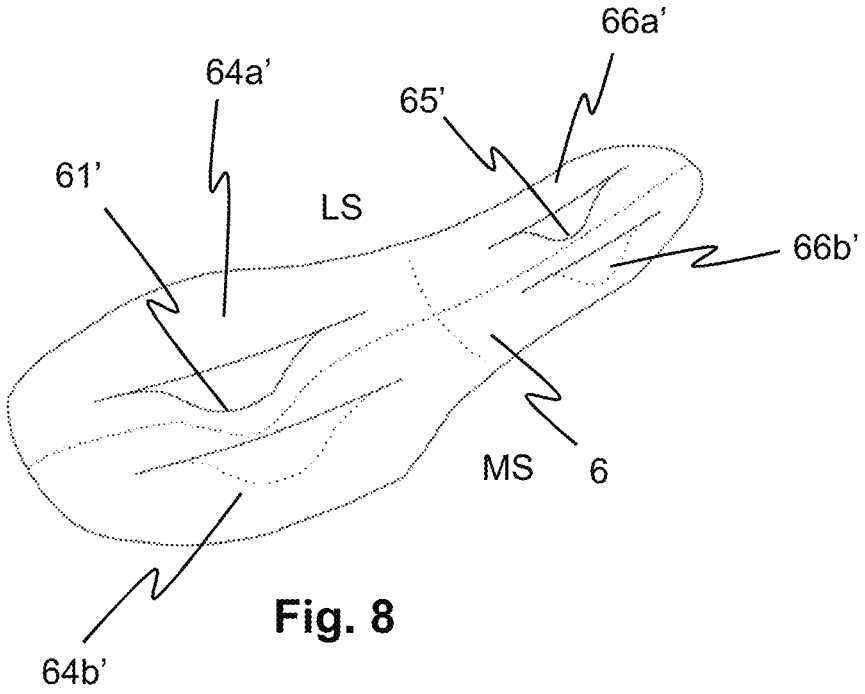
FIG. 8 shows schematically a view of a plate for a sole according to a further embodiment of the invention.

FIG. 1 shows the principle of energy conversion with a prior art sole comprising a flexurally elastic plate. If the runner shifts his weight in the running direction, i.e., in the direction of the sole tip, the plate causes a lifting effect. The force directed towards the ground in the forefoot region by the runner's toes is converted by the plate in the heel region into a force directed against the ground, thus supporting the push-off process.

FIG. 2 shows a running shoe with a sole comprising a midsole 1, a sole tip 4 and a heel edge 5 according to one embodiment of the invention. The midsole is divided into a forefoot region VFB, a heel region FB and a midfoot region MFB arranged therebetween along the longitudinal direction L, and has a base surface 3 delimiting the midsole against the vertical direction V of the midsole and a top surface 2 delimiting the midsole in the vertical direction V. In addition, the midsole 1 has an elastic plate 6 which, viewed against the longitudinal direction, extends from the forefoot region VFB over the midfoot region MFB into the heel region FB. In the forefoot region VFB, the sole has a first curvature 61 which, as shown, is curved in the direction of the top surface 2 of the midsole and has a vertex. In the embodiment shown, the first curvature 61 is bell-curve-shaped. The vertex is thereby arranged in the direction of the top surface 2, or in the vertical direction V. The elastic plate 6, in particular the first curvature 61, is configured such that the first curvature is elastically bent in the direction of the base surface by the forces acting during treading and/or rolling movement and the curvature returns to its original shape during push-off (see FIG. 7). The first curvature 61 partly delimits, or partly forms, the main channel 7, which can generally adjoin the first curvature 61 directly against the vertical direction. In addition to the main channel 7, the midsole 1 has rounded cushioning channels 82 in cross-section in the midfoot region and hexagonal cushioning channels 81 in cross-section in the heel region. Both the main channel 7 and the cushioning channels 81 and 82 extend end-to-end in the transverse direction from the medial side of the sole to the lateral side of the sole. The vertex of the first curvature 61 is arranged at a length L1 of about 70% of the total length L of the sole in the embodiment shown.

FIG. 3 schematically shows a cross-section along the longitudinal direction L and perpendicular to the transverse direction Q of a plate 6 as used in the embodiment of a plate of a sole according to the invention of FIG. 2. The plate 6 has a first curvature 61 curved along the longitudinal direction L of the midsole in the direction of the top surface of the midsole, i.e., in the vertical direction V, with a vertex S-61. In addition, the plate has a second curvature 62 curved along the longitudinal direction L of the midsole in the direction of the base surface of the midsole, i.e., against the vertical direction V, with a vertex S-62. The second curvature 62 is thereby arranged in longitudinal direction L between the first curvature and the sole tip (not shown, cf. FIG. 2). In addition, a third curvature 63 with vertex S-63 is provided, which is curved along the longitudinal direction L of the midsole in the direction of the base surface of the midsole, i.e., against the vertical direction V.

FIG. 4 shows a schematic perspective view of a plate 6 with the first curvature 61 as provided in the sole of FIG. 2. The first curvature 61 extends end-to-end in the transverse direction Q of the midsole and constant in the vertical direction from the medial side MS of the sole to the lateral side LS of the sole.

FIG. 5 shows a schematic perspective view of a plate 6 with the first curvature 61. In contrast to the plate of FIG. 4, the first curvature 61 is arranged only on the medial side MS of the sole. Along the transverse direction Q of the sole, the first curvature declines in the vertical direction V. In such embodiments, the plate may have no curvature on the lateral side LS.

FIG. 6 shows a schematic perspective view of a plate 6, the first curvature having a lateral-side curvature 61*a* curved along the longitudinal direction L of the midsole toward the top surface of the midsole and a separate medial-side curvature 61*b* arranged in a transverse direction and curved along the longitudinal direction of the midsole toward the top surface of the midsole. Intermediate curvature 61*c* is provided between the lateral-side curvature 61*a* and the medial-side curvature 61*b*, which is curved along the longitudinal direction of the midsole toward the base surface of the midsole. The lateral-side curvature 61*a* and the medial-side curvature 61*b* are thus curved in the vertical direction opposite to the intermediate curvature 61*c*, in particular complementary thereto. The medial-side and lateral-side curvatures thereby have an identical course along the longitudinal direction. They have the same inclination in the longitudinal direction.

FIG. 7 shows the operating principle of the plate of a sole according to the invention. FIG. 7*a*) shows the unloaded condition. When the runner steps on the ground with the sole, the weight of the runner during treading and the subsequent rolling movement of the foot bends the first curvature 61 in the direction of the base surface 3 {FIG. 7*b*}. In other words, the first curvature 61 is flattened. Since the plate 6 is generally elastic, in particular elastic in bending, the curvature returns to its original shape according to FIG. 7*a*). This generates a force with a component in the running direction which supports the push-off, allowing the runner to save force and fatigue few quickly. The main channel below the first curvature further enhances this effect. During push-off, the main channel 7 can be narrowed.

FIG. 8 shows a schematic perspective view of a plate 6 with a first curvature 61'. This is curved as part of a sole along the longitudinal direction L of the midsole in the direction of the base surface of the midsole. Arranged offset in transverse direction with respect thereto are planar sections 64*a*' and 64*b*' on lateral-side and medial-side, to which the elastic polymer material of the midsole can be attached. As part of a sole, the sections 64*a*' and 64*b*' are arranged substantially parallel to the base surface and the top surface of the midsole. Furthermore, the plate 6 has a further fourth curvature 65' in the heel region, in this case identical to the first curvature 61'. Also arranged offset in transverse direction are the two planar sections 66*a*' and 66*b*' on the medial-side and lateral-side. Consequently, the plate shown in FIG. 8 has only two curvatures curved along the longitudinal direction of the midsole in the direction of the base surface of the midsole, the first curvature 61' and the fourth curvature 65'. Thereby, the plate has only one curvature in the forefoot region and in the midfoot region, which is curved along the longitudinal direction of the midsole in the direction of the base surface.

Figure 9:
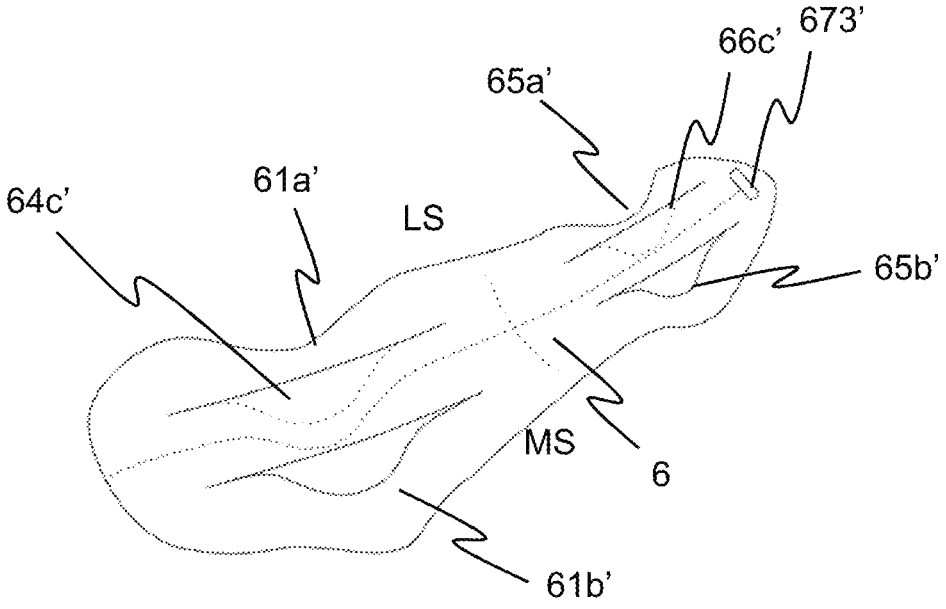
FIG. 9 shows schematically a view of a plate for a sole according to a further embodiment of the invention.

FIG. 9 shows a schematic perspective view of a plate 6. The first curvature consists of two separate, mutually separated curvatures, namely the lateral-side curvature 61*a*' facing the base surface in the installed state (i.e., as part of a base, cf. FIG. 2) and the medial-side curvature 61*b*' facing the base surface. The planar section 64*c*' is arranged between these two curvatures. Also in the heel region, the fourth curvature consists of two separate, mutually distinct curvatures, namely the lateral-side curvature 65*a*' directed toward the base surface in the installed state (i.e., as part of a sole, cf. FIG. 2) and the medial-side curvature 65*b*' directed toward the base surface. The planar section 66*c*' is arranged between these two curvatures.

Figure 10:
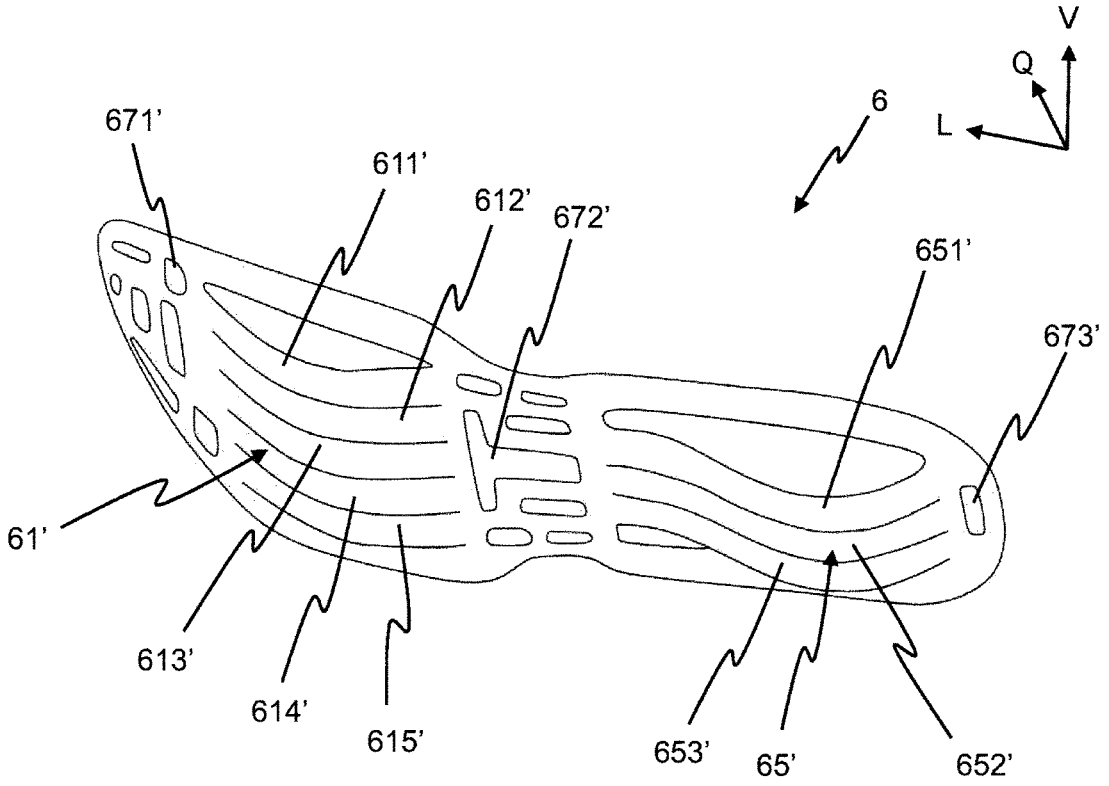
FIG. 10 shows schematically a view of a plate for a sole according to a further embodiment of the invention.

FIG. 10 shows a schematic perspective view of an elastic plate 6. Although the midsole is not shown, the viewer would look at the base surface of the sole in the present view, i.e., that side of the plate 6 is shown which faces the ground when worn. In this case, the elastic plate 6 has the first curvature 61' in the forefoot region and in the midfoot region and the fourth curvature 65' in the midfoot region and in the heel region, which are arranged one behind the other along the longitudinal direction and spaced apart from one another, i.e., separately from one another. The first curvature 61' is thereby segmented into 5 curvature segments 611', 612', 613', 614' and 615' separated from each other. The curvature segments are separated from each other by a gap. The first curvature 61' and all curvature segments 611' to 615' are curved along the longitudinal direction in the direction of the base surface of the sole (not shown, cf. FIG. 2). The segmentation allows better control of the push-off and stability, since, for example, a runner with a relatively large medial-side weight distribution can specifically elastically deform the first three medial-side curvature segments. The fourth curvature 65' is segmented into a total of three curvature segments 651', 652' and 653'. As with the first curvature 61', the fourth curvature and all of the curvature segments 651', 652' and 653' are curved along the longitudinal direction toward the base surface of the sole. In addition, the elastic plate 6 defines a plurality of through-holes 671', 672' and 673' (for clarity, only these three holes are denoted by reference signs). All of these holes extend through the elastic plate in the vertical direction V. However, this does not mean that these holes must be hollow elements in the sole. In some embodiments, it is generally possible for the material of the midsole, such as a polymer foam, to fill these holes, particularly completely. As can be seen, the through-holes 671' to 673' are each arranged in the longitudinal direction in front of and/or behind one of the curvatures, for example the first curvature 61' and/or the fourth curvature 65'. The through-hole 671 is arranged in the forefoot region in front of the first curvature 61', the through-hole 672' is arranged in the midfoot region in front of the fourth curvature 65' and behind the first curvature 61', and the through-hole 673' is arranged in the heel region behind the fourth curvature 65'.

Figure 11:
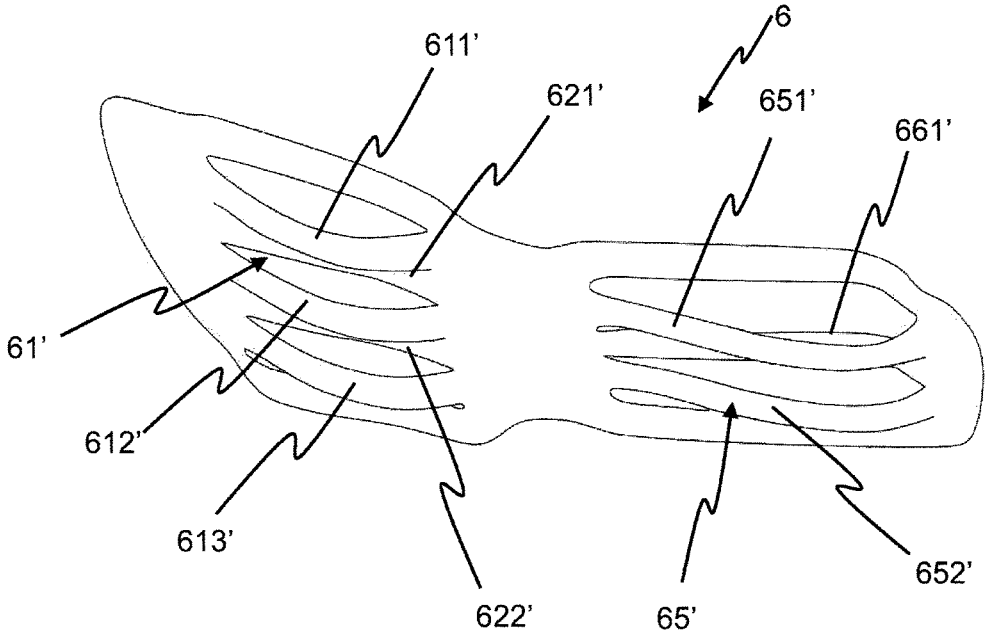
FIG. 11 shows schematically a view of a plate for a sole according to a further embodiment of the invention.

FIG. 11 shows a schematic perspective view of an elastic plate 6. Although the midsole is not shown, the viewer would look at the base surface of the sole in the present view, i.e., that side of the plate 6 is shown which faces the ground when worn. In this case, the elastic plate 6 has the first curvature 61' in the forefoot region and in the midfoot region and the fourth curvature 65' in the midfoot region and in the heel region, which are arranged one behind the other along the longitudinal direction and spaced apart from one another, i.e., separately from one another. The first curvature 61' is thereby segmented into 5 curvature segments 611', 612', 613', 621' and 622' separated from each other. Three curvature segments 611', 612' and 613' are curved along the longitudinal direction in the direction of the base surface of the sole like those in FIG. 10. In contrast, the other two curvature segments 621' and 622' are curved along the longitudinal direction in the opposite direction, namely toward the top surface of the sole. In this case, curvature segment 611' forms a medial-side curvature segment, curvature segment 613' forms a lateral-side curvature segment, and curvature segment 612' forms a central curvature segment arranged therebetween. The curvature segment 621' is arranged between the medial-side curvature segment 611' and the central curvature segment 612'. Between the lateral-side curvature segment 613' and the central curvature segment 612' is arranged the curvature segment 622'. The fourth curvature 65' is segmented into a total of three curvature segments 651', 652' and 661'. The medial-side curvature segment 651' and the lateral-side curvature segment 652' are curved along the longitudinal direction toward the base surface of the sole. In contrast, the third curvature segment 661' arranged between these two curvature segments is curved in the opposite direction, namely toward the top surface of the sole.

Figure 12:
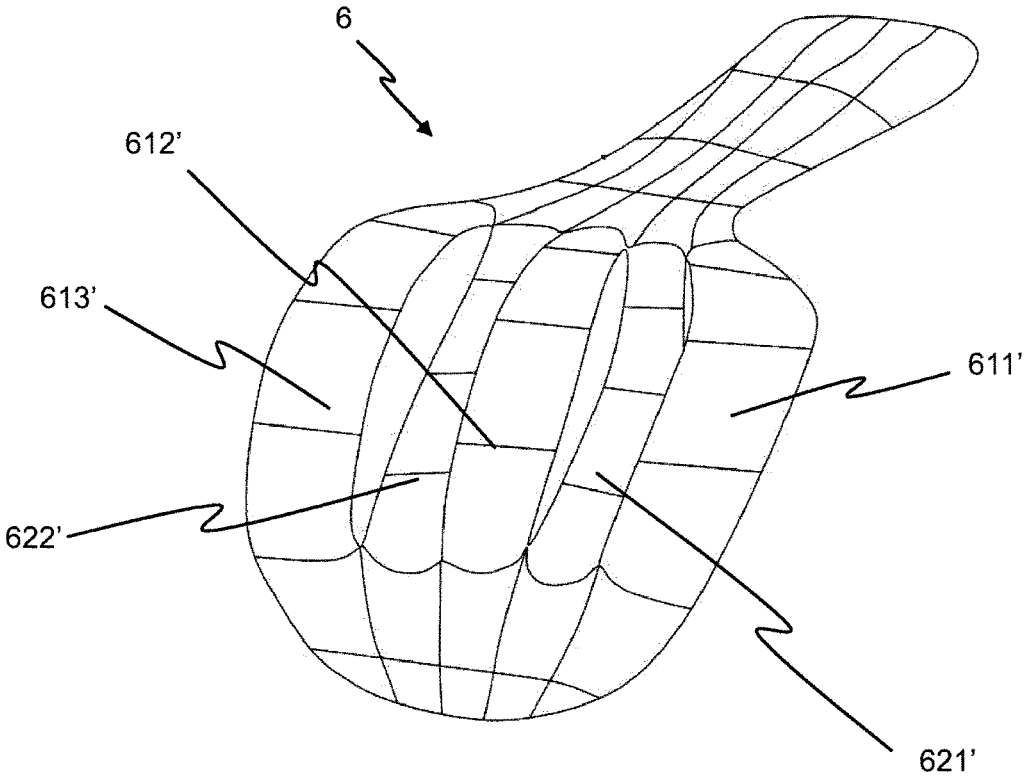
FIG. 12 shows schematically a view of a plate for a sole according to a further embodiment of the invention.

FIG. 12 shows another perspective view of another elastic plate 6. As in the embodiment shown in FIG. 11, the first curvature 5 has curvature segments 611', 612', 613' which are curved along the longitudinal direction towards the base surface of the sole. On the other hand, the other two curvature segments 621' and 622' are curved along the longitudinal direction in the opposite direction, namely towards the top surface of the sole. Instead of the curvature segments 621' and 622', planar sections can also be provided, i.e., sections which are substantially parallel to the base surface and/or the top surface of the sole. Like the curvature segments 621' and 622', these are then arranged between two each of the curvature segments 611', 612' and 613'.

Figure 13A:
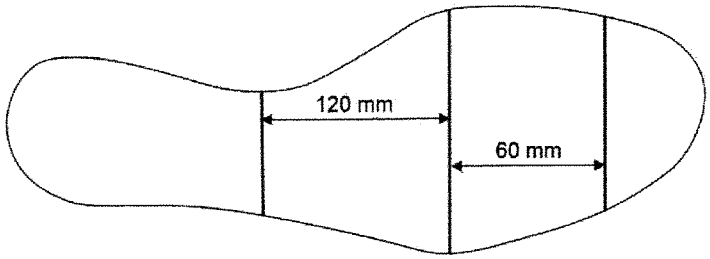
FIG. 13*a* shows sole measurements for the graph shown in FIG. 13*b*.
Figure 13B:
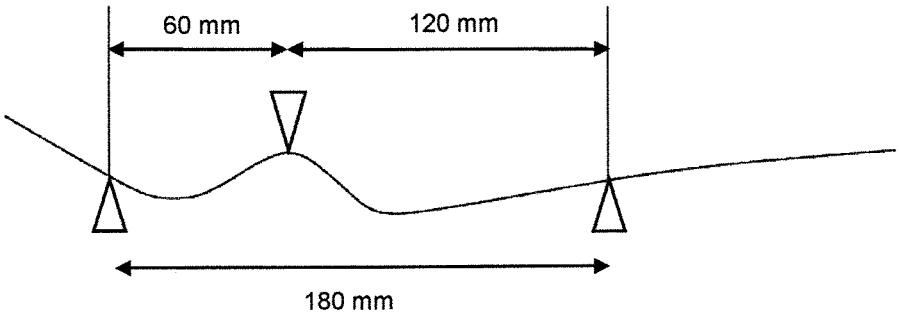
FIG. 13*b* shows a schematic view of the measurement for the flexural modulus according to test method 1.

FIGS. 13*a* and *b* show how the flexural modulus can be determined according to Test Method 1. Two support pins are arranged at a distance of 180 mm from each other and contact the elastic plate. A loading pin is arranged between the two support pins, which has a distance of 60 mm from the front support pin along the longitudinal direction and a distance of 120 mm from the rear support pin. As can be seen in FIG. 13*a*, the loading pin is positioned at the point where the elastic plate has the greatest expansion in the transverse direction or reaches its maximum.

The invention claimed is:

1. A sole for a running shoe, comprising a sole tip (4), a heel edge (5) and a midsole (1) having a base surface (3) delimiting the midsole against the vertical direction (V) of the midsole and a top surface (2) delimiting the midsole in vertical direction (V) wherein the midsole (1) comprises a heel region (FB), a midfoot region (MFB) and a forefoot region (VFB), and wherein the midsole (1) comprises an elastic plate (6), wherein the elastic plate (6) extends at least from the forefoot region (VFB) into the midfoot region (MFB) and wherein:

the elastic plate (6), in the forefoot region (VFB) and/or in the midfoot region (MFB), has a first curvature (61')

curved along a longitudinal direction (L) of the midsole (1) in the direction of the base surface (3) of the midsole (1) and having a vertex (S-61') wherein the elastic plate (6) is configured such that the first curvature (61') is elastically bent in the direction of the top surface (2) by the forces acting during running when treading and/or rolling movement, and the first curvature (61') returns to its original shape when pushing off; and the first curvature (61') comprising a lateral-side curvature curved along the longitudinal direction of the midsole in the direction of the base surface, and a separated medial-side curvature arranged offset in a transverse direction and curved along the longitudinal direction of the midsole in the direction of the base surface, and a planar section in a transverse direction arranged between the medial-side curvature and the lateral side curvature.

2. The sole according to claim 1, wherein the midsole (1) comprises a main channel (7) extending in the transverse direction (Q), which is formed at least partially by the first curvature (61) curved in the direction of the base surface (3).

3. The sole according to claim 2, wherein the main channel (7) extends end-to-end in the transverse direction (Q) from the medial side (MS) of the midsole (1) to the lateral side (LS) of the midsole (1).

4. The sole according to claim 1, wherein the first curvature (61, 61') is bell-curve-shaped in cross-section along the longitudinal direction (L) of the midsole (1) and perpendicular to the transverse direction (Q) of the midsole (1).

5. The sole according to claim 1, wherein the first curvature (61, 61') is arranged such that, in the operative state, they are arranged in the vertical direction (V) below the metatarsophalangeal joints of the wearer.

6. The sole according to claim 1, wherein the vertex (S-61, S-61') of the first curvature (61, 61') from the heel edge (5) of the sole in the direction of the sole tip (4) is arranged at 50% to 75% of the total length (L(tot)) in the longitudinal direction (L) of the sole.

7. The sole according to claim 1, wherein the first curvature (61, 61') at the vertex (S-61, S-61') in cross-section along the longitudinal direction (L) and perpendicular to the transverse direction (Q) has a vertex radius of 1 mm to 200 mm.

8. The sole according to claim 1, wherein the elastic plate (6), arranged offset in transverse direction (Q) with respect to the first curvature (61, 61'), has one or more planar sections (64*a*', 64*b*', 64*c*'), which extends in longitudinal direction (L), parallel to the top surface (2) and/or parallel to the base surface (3).

9. The sole according to claim 1, wherein the elastic plate (6) comprises, in addition to the first curvature (61) curved in the direction of the top surface (2) of the midsole (1), a second curvature (62) curved along the longitudinal direction (L) of the midsole (1) in the direction of the base surface (3) of the midsole (1) and having a vertex (S-62), wherein the second curvature (62) is arranged in the longitudinal direction between the first curvature (61) and the sole tip (4).

10. The sole according to claim 9, wherein the second curvature (62) has at its vertex (S-62) a vertex radius in cross-section along the longitudinal direction (L) and perpendicular to the transverse direction (Q) of from 5 mm to 300 mm.

11. The sole according to claim 1, wherein the elastic plate (6) has, in addition to the first curvature (61) curved in the direction of the top surface (2) of the midsole (1), a third curvature (63) curved along the longitudinal direction (L) of the midsole (1) in the direction of the base surface (3) of the midsole (1) and having a vertex (S-63), wherein the third curvature (63) is arranged in the longitudinal direction (L) between the heel edge (5) and the first curvature (61).

12. The sole according to claim 11, wherein the third curvature (63) has a vertex radius of from 5 to 300 mm, at its vertex (S-63).

13. The sole according to claim 12, wherein the distance in the longitudinal direction (L) between the vertex (S-62) of the second curvature (62) and the vertex (S-63) of the third curvature (63) is 40 mm to 90 mm.

14. The sole according to claim 9, wherein the elastic plate (6) has a lower stiffness in the region of the second curvature (62) and/or in the region of the third curvature (63) than at the rest of the plate (6).

15. The sole according to claim 9, wherein the vertex (S-61) of the first curvature (61) is arranged offset from the vertex (S-62) of the second curvature (62) and/or from the vertex (S-63) of the third curvature (63) in the vertical direction (V) by 5 mm to 30 mm, in particular by 10 mm to 20 mm.

16. The sole according to claim 1, wherein the first curvature (61) curved in the direction of the top surface (2) of the midsole (1) comprises a lateral-side curvature (61*a*) curved along the longitudinal direction (L) of the midsole (1) in the direction of the top surface (2) of the midsole (1) and a therefrom separated medial-side curvature (61*b*) arranged offset in transverse direction (Q) and curved along the longitudinal direction (L) of the midsole (1) in the direction of the top surface (2) of the midsole (1).

17. The sole according to claim 16, wherein an intermediate curvature (61*c*) curved along the longitudinal direction (L) of the midsole (1) in the direction of the base surface (3) of the midsole (1) is arranged in the transverse direction (Q) between the medial-side curvature (61*b*) curved in the direction of the top surface (2) of the midsole (1) and the lateral-side curvature (61*a*) curved in the direction of the top surface (2) of the midsole (1).

18. The sole according to claim 1, wherein the planar section (64*c*') is arranged in the transverse direction (Q) between the medial-side curvature segment (61*b*') curved in the direction of the base surface (3) of the midsole (1) and the lateral-side curvature segment (61*a*') curved in the direction of the base surface (3) of the midsole (1), which planar section is arranged substantially parallel to the top surface (2) and/or parallel to the base surface (3).

19. The sole according to claim 1, wherein the first curvature (61') is segmented into curvature segments (611', 612', 613', 614', 615') that are separate from one another and arranged offset in the transverse direction (Q).

20. The sole according to claim 19, wherein each curvature segment (611', 612', 613', 614', 615') is one of:

a. curved independently of the other curvature segments along the longitudinal direction toward the top surface (2) of the midsole (1) and b. curved along the longitudinal direction toward the base surface (3) of the midsole (1).

21. The sole according to claim 19, wherein at least one of:

a. at least two curvature segments (611', 612', 613', 614', 615') are directly adjacent in transverse direction (Q) and b. wherein a planar section is arranged between two adjacent curvature segments, which planar section is arranged substantially parallel to the top surface (2) and/or parallel to the base surface (3).

22. The sole according to claim 1 wherein one of:

a. the elastic plate (6) in the heel region (FB) has a fourth curvature with a vertex, curved along the longitudinal direction (L) of the midsole (1) in the direction of the top surface (2) of the midsole (1) wherein the elastic plate (6) is configured such that the fourth curvature is elastically bent in the direction of the base surface (3) by the forces acting during treading and/or during rolling movement, and the fourth curvature (65) returns to its original shape during push-off; and b. the elastic plate (6) in the heel region (FB) has a fourth curvature (65', 65*a*', 65*b*') curved along the longitudinal direction (L) of the midsole (1) in the direction of the base surface (3) of the midsole (1) and having a vertex, wherein the elastic plate (6) is formed in such a manner that the fourth curvature (65', 65*a*', 65*b*') is elastically bent in the direction of the top surface (2) by the forces acting during treading and/or during rolling movement, and the fourth curvature (65', 65*a*', 65*b*') returns to its original shape during push-off.

23. The sole according to claim 22, wherein the fourth curvature (65', 65*a*', 65*b*') is segmented into curvature segments (651', 652', 653') separate from one another and arranged offset in the transverse direction (Q).

24. The sole according to claim 1, wherein the elastic plate (6) defines a plurality of through-holes (671', 672', 673') which extend in the vertical direction (V) and which are arranged in the heel region and/or in the forefoot region and/or in the midfoot region.

25. The sole according to claim 1, wherein the midsole (1) has a plurality of cushioning channels (81, 82) running in the transverse direction (Q), arranged one behind the other in the longitudinal direction (L).

26. A running shoe comprising a sole according to claim 1.

27. A sole for a running shoe, comprising a sole tip (4), a heel edge (5) and a midsole (1) having a base surface (3) delimiting the midsole against the vertical direction (V) of the midsole and a top surface (2) delimiting the midsole in vertical direction (V) wherein the midsole (1) comprises a heel region (FB), a midfoot region (MFB) and a forefoot region (VFB), and wherein the midsole (1) comprises an elastic plate (6), wherein the elastic plate (6) extends at least from the forefoot region (VFB) into the midfoot region (MFB) and wherein the elastic plate (6), in the forefoot region (VFB) and/or in the midfoot region (MFB) has a first curvature (61') curved along a longitudinal direction (L) of the midsole (1) in the direction of the base surface (3) of the midsole (1) and having a vertex (S-61') wherein the elastic plate (6) is configured such that the first curvature (61') is elastically bent in the direction of the top surface (2) by the forces acting during running when treading and/or rolling movement, and the first curvature (61') returns to its original shape when pushing-off; and the first curvature (61') comprising a lateral-side curvature curved along the longitudinal direction of the midsole in the direction of the base surface, a therefrom separated medial-side curvature arranged offset in a transverse direction and curved along the longitudinal direction of the midsole in the direction of the base surface, and a plate section of the plate being in a transverse direction arranged between the medial-side curvature and the lateral-side curvature.

* * * * *